United States Patent [19]

Merz

[11] 4,082,190

[45] Apr. 4, 1978

[54] DESK ORGANIZER

[76] Inventor: Eric Robert Merz, 12 Shoestring La., Brookhaven, N.Y. 11719

[21] Appl. No.: 604,427

[22] Filed: Aug. 13, 1975

[51] Int. Cl.[2] ..... B42F 1/00; A47F 7/00

[52] U.S. Cl. ..... 211/11; 24/67.11; 24/259 R; 211/50

[58] Field of Search ..... 211/11, 50, 51, 88, 211/126, 10; 206/73; 40/19.5, 124; 16/1; 281/45; D74/12, 9 R, 9 A, 2 R, 2 A, 2 B, 2 C; D19/21, 36, 67, 75, 76, 78, 77, 86, 87, 90, 92, 94, 96–99; 24/243 P, 264, 255 FC, 255 P, 255 S, 67.3, 248 PC, 137, 79, 43, 73 MF, 73 P, 73 SB, 73 SM, 259 R, 259 PF, 67.11

[56] References Cited

U.S. PATENT DOCUMENTS

| | | | |
|---|---|---|---|
| 812,800 | 2/1906 | McLean | 24/259 PF |
| 1,407,720 | 2/1922 | Boyett | 211/51 |
| 1,637,564 | 8/1927 | Gillette | 24/259 PF |
| 2,329,974 | 9/1943 | Bennett | 24/259 PF |
| 2,428,618 | 10/1947 | Dispensiere | 24/255 P |
| 2,564,518 | 8/1951 | Bedinger | 211/51 |
| 3,023,474 | 3/1962 | Shears | 24/69.11 X |

FOREIGN PATENT DOCUMENTS

| | | | |
|---|---|---|---|
| 514,010 | 10/1939 | United Kingdom | 24/259 PF |

*Primary Examiner*—Roy D. Frazier
*Assistant Examiner*—Terrell P. Lewis
*Attorney, Agent, or Firm*—Daniel M. Schaeffer

[57] ABSTRACT

A desk-organizer for releasibly holding paper and the like for ready reference and retrievel, including a resilient paper-holder of transparent plastic or of wire, the paper-holder in the form of a bifurcate structure having at least a pair of extending members joined at a crotch in facing relationship, with a projecting member extending from the end of a first one of the extended members remote from the crotch to form with the second extended member an oriented-access, the oriented-access self-biased to urgedly engage sheet material inserted therein. Extending from the end of the second extended member remote from the crotch is a second projecting member which interacts with sheet material extending away from the crotch beyond the oriented-access to flex the sheet material into a non-planar configuration having improved structural stability.

Various arrangements of at least one resilient paper-holder alone or in combination with a base can be used to provide functional substitutes for such desk accessories as the in-and-out box, the letter tray, the spindle, and the paperweight.

8 Claims, 7 Drawing Figures

DESK ORGANIZER

BACKGROUND OF THE INVENTION

The trend in modern office furnishing is towards a decor featuring clean lines, unobstructed surfaces, and functionally uncluttered space. Unfortunately this idealistic concept cannot coexist with reality, for, when real people are seriously at work, mounds of paper tend to accumulate on all available horizontal surfaces, creating the appearance of unfunctional clutter. At one time, the roll-top desk served admirably with its array of pigeonholes for the short-term storage, segregation, and ordering of letter correspondence and like current-interest material requiring frequent, retrievable access. But now, the roll-top desk has been relegated to the museum and the antique shop, and there is a pressing need for a functional equivalent of the pigeonhole. The traditional in-and-out box of the type generally found on the secretary's desk and on the executive's desk, which comprises a plurality of bulky, open-top, letter-size, rectangular boxes, arranged in a spaced vertical tier, and supported by four corner posts, provides, at best, a poor substitute for but a few of the many functions of the pigeonhole array.

Attempts to modernize and improve the in-and-out box have resulted in minor changes, changes that are cosmetic rather than functional. Such changes are commonly characterized by the use of free-form molding technique with fiber-glass reinforced plastic and like material of high structural strength to eliminate corner posts and side-walls so as to produce an integral structure in which a tier of spaced-apart letter-size trays are cantilevered from a single end support.

Office-furnishing consultants and designers consider such free-form paper valets cumbersome, unwieldy, unsightly, and aesthetically distasteful. Instead, they specify low-silhouette, adjacently-paired, open-top, letter-size, rectangular boxes for desk-top use, or, preferably, provide separate drawers, hidden within the desk, for holding incoming and outgoing correspondence and other business material of current interest.

A recurring problem with paper valets, both modern and traditional, as well as with the hidden drawers, is that these devices are all designed to accommodate sheet material of a pre-specified maximum size, be it letter-size or legal size. Oversize material, such as accounting ledger sheets, time sheets, scheduling sheets, computer print-outs, specification sheets, and drawings cannot be accomodated readily without folding. And, when such oversize material is squeezed into an existing paper valet, the ends generally overhang the confines, presenting a generally sloppy appearance and increasing the likelihood of spillage.

To reduce the likelihood of spillage, a pile of papers in a paper valet is normally held down with a paperweight. The paperweight is also used to prevent scattering of a pile of papers placed on the desk-top for future reference.

The spindle, which was the familiar companion of the roll-top desk, provided a convenient repository for the temporary storage of special items and small papers such as bills, memoranda, and the like which might become lost in the pigeonholes. Nowadays, the sharp spike end of the spindle makes it too hazardous for general office use. More compelling than any safety reason, or aesthetic reason, is the use of computer punch-card billing which has doomed the use of the spindle. The admonition not to punch, tear, fold, spindle, or multilate has relegated the spindle to the status of another quaint and anachronistic device to be used only by nostalgia buffs.

Nostalgic or not, the roll-top desk with its pigeonholes, and accompanying paperweights and spindle, satisfied functional needs in a manner that has not been equalled by modern desk accessories or desk-organizers.

What is needed at this time is a new and novel desk-organizer that is functionally capable of accommodating papers of any size and dimension with equal facility, that will releasably store these papers in a neat, uncluttered array without danger of spillage, and that will be compatible with, and not in conflict with, modern office furnishings.

Preferably, the desk-organizer should be unobtrusive when not being used to hold papers. It should occupy a minimum of desk space when in use. Further, the desk-organizer should be readily capable of relocation as desired on the top of the desk, preferably by the use of only one hand, as when the other hand is occupied (as by holding the telephone receiver) and immediate reference is desired without the hazard of spillage.

Summarizing these needs: the desired desk-organizer should combine all of the desirable functional features of the pigeonhole, the paperweight, and the spindle into one aesthetically pleasing structure that is compatible with modern office decor.

SUMMARY OF THE INVENTION

Now, I have provided for these and other needs by my new and novel invention in the form of an aesthetically attractive as well as elegantly functional desk-organizer that is unobtrusive when not in use, occupying no more space on a desk top than an average size glass ash-tray, and that simultaneously accommodates such disparate material as bills, letter correspondence, legal forms, and accounting ledger forms of any size, while still providing the capability of being moved from one position to another on a desk top by the use of only one hand without danger of spillage or loss of contents.

The new and novel desk-organizer of my invention comprises at least one resilient paper-holder, preferably of transparent material, in the form of a unitary bifurcate structure having first and second facing extended members joined at a crotch. A projecting member extends from the end of the first extended member to form an oriented-access for feeding paper and like sheet material into a self-biased clamp means for gripping the sheet material. A second projecting member which extends away from the crotch from the end of the second extended member, is positioned to interact with that portion of the sheet material that extends out beyond the clamp means when the sheet material is held by the clamp means. The interaction with the sheet material causes the sheet material to flex into a non-planar configuration which has improved structural stability along at least one axis.

In all of the various embodiments of the desk-organizer of my invention, like-size sheet material can be segregated and releasably held with the individual sheet members aligned along a side in an array which facilitates the selective location and retrieval of a desired item by the riffling of the accessible sides of the sheet members with the fingers of one hand. This contrasts with the two-handed paper-shuffling required for a similar location and retrieval when most prior art paper storage devices are used.

Whereas one-handed selective location was facilitated when the now-antique spindle was used for the temporary storage of bills and the like, retrieval required either multilation by tearing when one-handed retrieval was used, or the two-handed removal of all the material spindled above the selected item. My versatile desk-organizer now provides in a single desk accessory an acceptable, modern, and safe functional replacement for the old-fashioned and unsafe spindle, as well as a superior functional replacement for the cumbersome traditional in-and-out box and the paper valet.

In accordance with the practice of my invention, I can utilize a plurality of paper-holders, or a single paper-holder, either alone or in combination with a base, to releasibly hold papers. The oriented-access can be directed laterally or vertically. When I utilize a single paper-holder without a base, with the oriented-access directed laterally, my invention is a functional substitute for the paperweight or the spindle, since my invention in this form will immobolize a sheaf of papers on a surface and the like. When I utilize a single paper-holder, with the oriented-access directed vertically, my invention is the functional equivalent of the pigeonhole or the spindle. When I utilize a plurality of the paper-holders of my invention in a tiered arrangement supported on a base with each oriented-access directed laterally, my invention is the functional equivalent of the in-and-out box. In each of the above situations, my invention provides additional functions to those enumerated, functions that cannot be provided by the paperweight, the spindle, the in-and-out box, or the collator.

These and other advantages of my invention will become apparent from consideration of the accompanying description of the preferred embodiments when taken together with the appended drawing.

DESCRIPTION OF THE PREFERRED EMBODIMENTS

Figure 1:
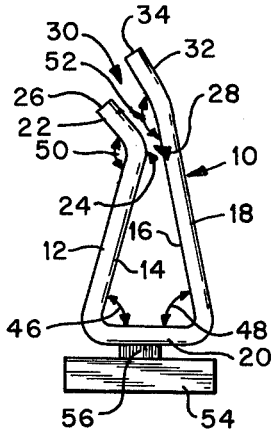
FIG. 1 is a side view of a preferred embodiment of the desk-organizer of my invention having a single resilient paper-holder mounted on a base with the oriented-access of the paper-holder directed vertically.

Referring now to the various figures of the drawing wherein like reference symbols identify like elements, the desk-organizer of my invention comprises a resilient paper-holder 10 having a a first extended member 12 with an extended surface 14 facing an extended surface 16 of a second extended member 18, extended member 12 and extended member 18 joined at crotch member 20 to form a unitary structure. Projecting member 22 extends from the end of first extended member 12 distant from crotch 20 between knee 24 and projecting member terminus 26. In the embodiment of FIG. 1, knee 24 and extended surface 16 cooperated to provide a self-biased clamp means 28 for releasibly securing sheet material inserted therebetween. In the embodiments of the remaining figures of the drawing, except FIG. 6*a*, terminus 26 and extended surface 16 of extended member 18 cooperatively provide the self-biased clamp means in a functionally similar manner. In all embodiments, projecting member 22 and second extended member 18 together define an oriented-access means 30 for facilitating the insertion of sheet material into the self-biased clamp means 28. Extended member 12, extended member 18, and crotch member 20 are so arranged, as will be obvious to those skilled in the art, to urgedly engage sheet material inserted crotchward through oriented-access 30 and to resiliently dilate to accommodate a plurality of insertions of additional sheet material, up to a maximum total thickness of sheet material determined by structural strength limitations of the material used for fabrication of paper-holder 10, which can be of any resilient material including metal, but which I prefer to be of a transparent substantially self-supporting plastic such as acrylic polymer.

Figure 4:
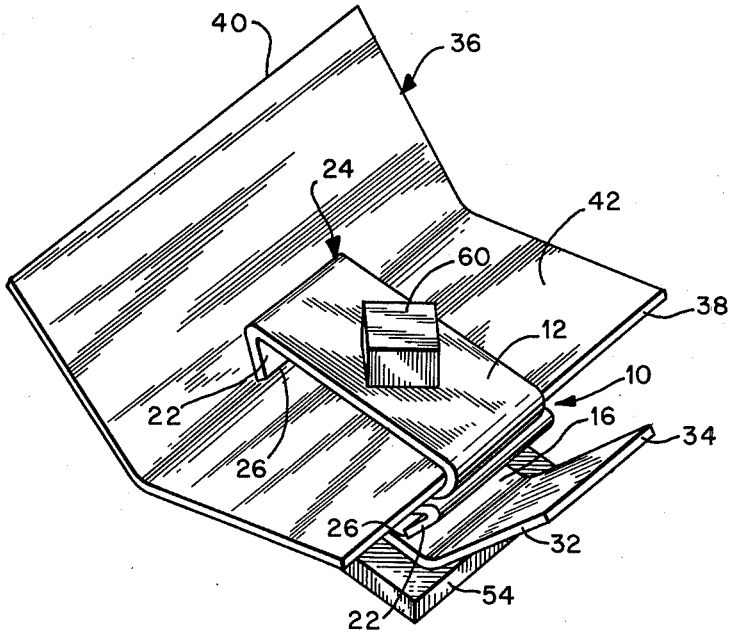
FIG. 4 is a perspective view of still another preferred embodiment of the desk-organizer of my invention illustrating how the structural stability of the sheet material held therein is substantially improved by the flexing thereof along at least one axis.

Second projecting member 32 extends from the end of second extended member 18 distant from crotch 20 and beyond clamp means 28, roughly parallel to first projecting member 22, and spaced apart therefrom by a distance equal to about the above-discussed maximum total thickness of sheet material, terminating at end 34, positioned with reference to oriented-access 30 so that when sheet material has been inserted therethrough and is engaged by clamp means 28 the extended portion of the sheet material remaining in the oriented-access will interact with projecting member 32 so as to flex the sheet material into a non-planar configuration having improved structural stability along at least one axis. The flexing of the sheet material by this interaction is illustrated in FIG. 4 and in FIG. 5 where sheet material 36 and 36' each comprise a plurality of substantially identical size sheets of paper or the like having a first rectilinear end 38, an opposite substantially parallel end 40, an upper extended surface 42 and a lower extended surface 44. As can be seen in the drawing, more particularly in FIG. 5, the clamp means comprised of projecting member 22 and extended member 18 urgedly engages sheet material 36 and 36', with terminus 26 in contact with sheet material upper surface 42 and extended surface 16 contacting a portion of the sheet material lower surface 44, while end 34 of projecting member 32 interacts with sheet material 36, 36' by contacting another portion of lower surface 44 causing flexure such that end 40 of sheet material 36 is elevated above end 38 and sheet material 36 has a non-planar configuration having improved structure stability.

Figure 3:
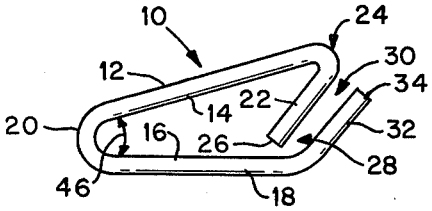
FIG. 3 is a side view of a desk-organizer of my invention in which I employ a single paper-holder without a base support.

Referring now to FIG. 1, paper-holder 10 is of a unitary resilient material, preferably a transparent acrylic polymer sheet, formed, as by thermally bending, into the illustrated bifurcate structure having substantially planar rectilinear elements, with adjacently joined elements meeting at dihedral angles such that the apices of the dihedral angles define a series of mutually parallel lines. Thus, first extended member 12 meets crotch member 20 at dihedral angle 46; second extended member 18 meets crotch member 20 at dihedral angle 48; first extended member 12 and first projecting member 22 form dihedral angle 50 at knee 24; and, second extended member 18 joins second projecting member at dihedral angle 52. In all embodiments of my invention, dihedral angle 52 is always an obtuse angle. When dihedral angle 50 faces away from extended surface 16, as shown in FIG. 1, dihedral angle 50 is obtuse; when it faces towards extended surface 16, as shown in the other figures of the drawing, dihedral angle 50 in an acute angle. Dihedral angle 46 and dihedral angle 48 are not critical and can even coalesce into a single dihedral angle 46 as illustrated in FIG. 3 and more particularly in FIG. 5.

In FIG. 1, paper-holder 10 is mounted for support on a base member 54, adapted to stable support on an extended surface, with oriented-access 30 directed vertically and with spacer member 56 adhesively attached intermediate crotch member 20 and base member 54. The use of spacer member 56 permits resilient flexure of dihedral angle 46 and dihedral angle 48 as the amount and thickness of the sheet material held by paper-holder 10 is varied.

Because of the arrangement of first extending member 12 and second extending member 18, which members are further apart at the crotch than at any distance away from the crotch, and because of the inherent resilience in acrylic polymer sheet of the type preferred, I find that I can store a plurality of sheets of paper and the like in the paper-holder of the desk-organizer of my invention, which plurality of sheets is of a thickness substantially equal to the span of crotch member 20 between dihedral angle 46 and dihedral angle 48. This plurality of sheets of paper can be measured for insertion by the separation between projecting member 22 and projecting member 32, as heretofore discussed. Further, this plurality of sheets of paper can even take the form of an opened bound book. And, when I use the embodiment of FIG. 1 to support an opened book in position for reading, I prefer to have the printed pages facing towards extended member 18.

Figure 2:
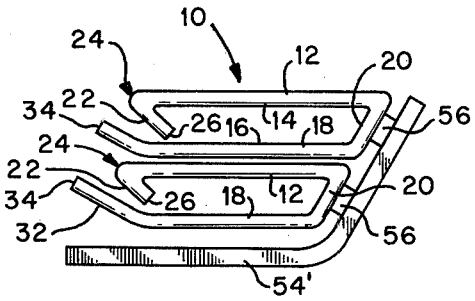
FIG. 2 is a side view of another preferred embodiment of my invention in which a plurality of resilient paper-holders are supported in spaced relationship on a common support with each oriented-access directed laterally.

Now, having described in detail the structure, function, and mode of operation of the preferred embodiment of FIG. 1, those skilled in the art will readily appreciate that the other figures of the drawing illustrate embodiments and variations employing the same underlying structure and principles. Thus, FIG. 2 shows a desk-organizer embodiment comprising two paper-holder 10 elements, each paper-holder mounted with its oriented-access directed laterally and in the same direction, and supported on a base member 54' with a spacer member 56 for each paper-holder 10. FIG. 3 shows a desk-organizer for use without a base member, acting as a paperweight. It will be obvious to those skilled in the art that the paper-holder of FIG. 1 could also be used in the configuration of the embodiment of FIG. 3. Similarly, it would be obvious to those skilled in the art to make the paper-holder 10 of FIG. 1 removably fastenable to base member 54 so that paper-holder 10 may be used alternatively in the configuration of FIG. 1 with or without its base member, or in the configuration of FIG. 3. Magnetic material and the like could be incorporated in the structure of paper-holder 10 to facilitate its use in such embodiments.

It will become obvious to those skilled in the art to use the configuration of the embodiment of FIG. 2 for collating and the like by providing a plurality of paper holders 10 in a parallel array on a modified base 54' adjusted so that each oriented-access was directed vertically, as by rotation of the desk-organizer of FIG. 2 clockwise through an angle of about 60°.

Figure 5:
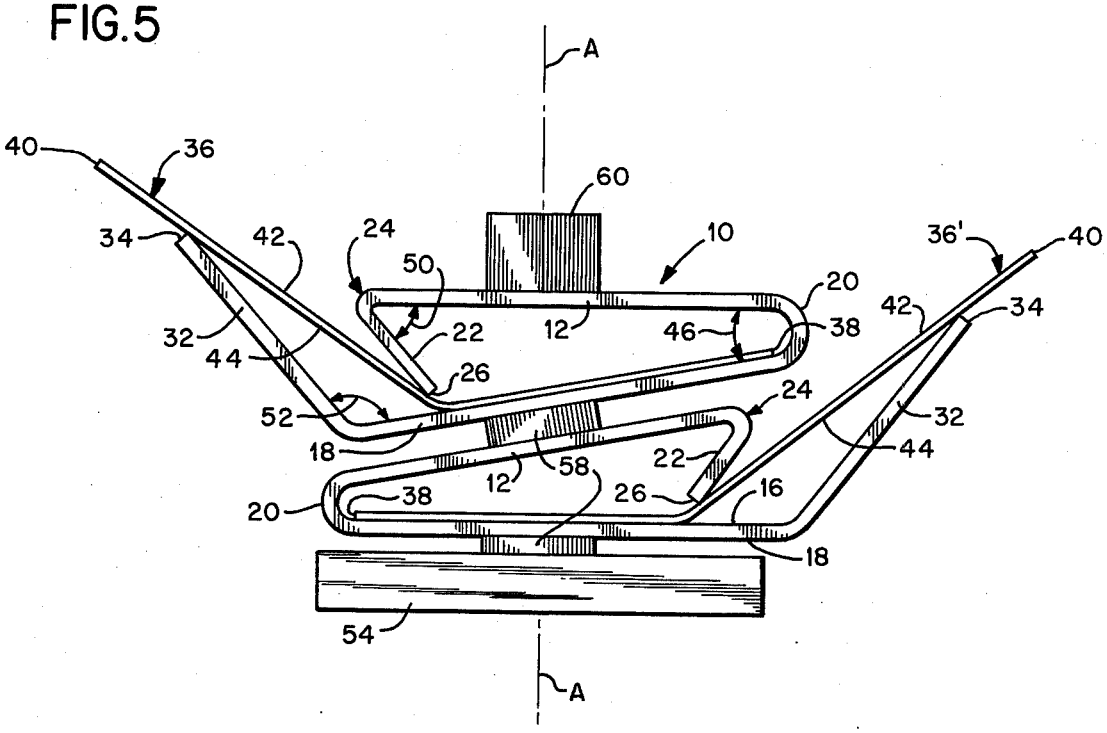
FIG. 5 is an enlarged side view of the desk-organizer of FIG. 4 showing two sets of sheet material segregated within the desk-organizer and made accessible for ready reference by one-handed edge-riffling.

A still further varient of the desk-organizer embodiment of FIG. 2 is shown in FIG. 4 and FIG. 5, comprising two paper-holders 10, each paper-holder mounted with its oriented-access directed laterally in outwardly opposed directions and supported on a base member 54 with a suitable spacer member 58 for each paper-holder 10, and a handle in the form of a cubical finial 60 mounted atop the uppermost paper-holder 10 on a vertical axis A—A intermediate the pair of oppositely-directed oriented-accesses. Because of the design requirements of the embodiment of FIG. 4 and FIG. 5, the dihedral angles defining the crotch have been coalesced, as discussed above, and each spacer member 58 is aligned on axis A—A joined to an exterior surface of an extended member 18.

Figure 6A:
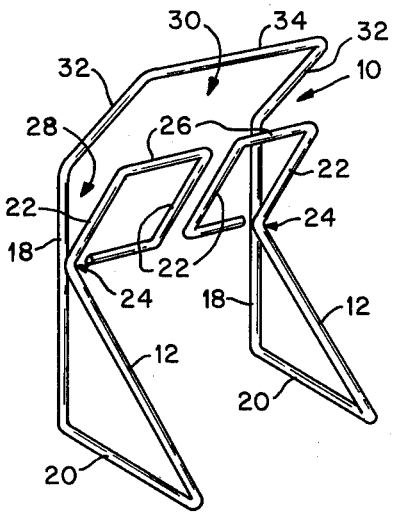
FIG. 6*a* is a perspective view of a paper-holder according to this invention in skeletal structure for construction using metal wire and like material.
Figure 6B:
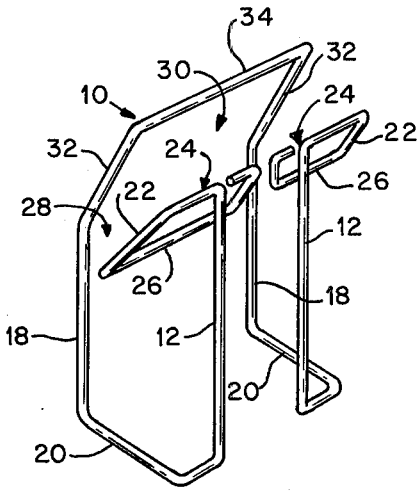
FIG. 6*b* is a perspective view similar to FIG. 6*a* of a further embodiment employing wire and like structural material.

Although the preferred material of construction for the embodiments illustrated in the first 5 figures of the drawing is an acrylic plastic of suitable transparency and resiliency, the same underlying structure can be employed with a skeletal structure and executed in wire and the like having suitable resiliency and rigidity. FIG. 6*a* and FIG. 6*b* illustrate two possible configurations for embodiments employing the critical elements which define the invention: namely, self-biased clamp means 28; oriented-access 30; crotch 20 which together with extended member 12 and extended member 18 define a bifurcate structure; projecting member 22; and, projecting member 32.

In light of this teaching, it will be obvious to employ both sheet acrylic plastic and wire and the like to make a hybrid structure without departing from the spirit of this invention. Further, it would be obvious to roll or curl terminus 26 and end 34 in such a way as to present a low friction surface instead of a sharp edge to interact with sheet material inserted in the paper-holder.

Now, having described the practice of this invention and the presently preferred embodiments in accord with the requirements of the statute, and realizing that skilled artisans and others will apply the teachings of this invention in a variety of differing ways to provide certain changes in the different embodiments of this invention without departing from the scope of this invention, it is intended that all the matter contained in the above description or shown in the accompanying drawing shall be interpreted as illustrative and not in a limiting sense and that the breadth of the invention be construed in accordance with the appended claims.

What is claimed is:

1. A desk-organizer for temporary storage and retrieval of letter correspondence and like matter comprising sheet material, said desk-organizer comprising:

a first paper-holder mounted on base means for stable support on an extended surface, said paper-holder comprising;

(a) unitary resilient means defining a bifurcate structure having at least a first extended member facing a second extended member and joined therewith at a crotch, said bifurcate structure comprising a plurality of planar rectilinear elements, (b) means forming an oriented-access for the insertion of said sheet material, said oriented-access comprising a first projecting member extending from the end of said first extended member remote from said crotch, said first projecting member extending towards said crotch and said second extended member, (c) means forming a self-biased clamp for urgedly engaging sheet material inserted through said oriented-access, and, (d) means for flexing said sheet material into a non-planar configuration having improved structural stability along at least one axis, said means for flexing comprising a second projecting member extending from the end of said second extended member remote from said crotch, said second projecting member extending away from said crotch and having a terminal end portion positioned to interact with that portion of said sheet material remote from said crotch extending beyond said self-biased clamp.

2. The desk-organizer of claim 1 which includes at least a second said paper-holder substantially identical to said first paper-holder.

3. The desk-organizer of claim 2 wherein said first paper-holder and said second paper-holder are arranged in a vertical tier with the said oriented-access of each said paper-holder directed laterally.

4. The desk-organizer of claim 3 wherein the said oriented-access of said second paper-holder and the said oriented-access of said second paper-holder are oppositely directed.

5. The desk-organizer of claim 4 wherein there is a first spacer between said base means and said first paper-holder and a second spacer between said first paper-holder and said second paper-holder, each said spacer positioned on a vertical axis, said axis defined by the mid-point of a line segment having at opposite ends the said oriented-access of each said paper-holder.

6. The desk organizer of claim 5 wherein each said paper-holder is transparent.

7. The desk-organizer of claim 6 wherein each said paper holder comprises acrylic polymer sheet formed into said plurality of planar, rectilinear elements along parallel bend lines.

8. The desk-organizer of claim 7 which includes handle means for the one-handed lifting and carrying of said desk-organizer and its contents, said handle means comprising a finial mounted on said vertical axis.

* * * * *